US008833814B2

(12) United States Patent
Chang

(10) Patent No.: US 8,833,814 B2
(45) Date of Patent: Sep. 16, 2014

(54) ELECTRIC LOCK DEVICE

(75) Inventor: Chih Chung Chang, Taipei (TW)

(73) Assignee: Gianni Industries Inc., Taipei (TW)

( * ) Notice: Subject to any disclaimer, the term of this patent is extended or adjusted under 35 U.S.C. 154(b) by 588 days.

(21) Appl. No.: 13/135,503

(22) Filed: Jul. 7, 2011

(65) Prior Publication Data

US 2013/0009409 A1 Jan. 10, 2013

(51) Int. Cl.

| | |
|---|---|
| ***E05B 15/02*** | (2006.01) |
| ***E05B 47/00*** | (2006.01) |
| ***E05B 63/00*** | (2006.01) |
| *E05B 15/00* | (2006.01) |

(52) U.S. Cl.

CPC ..... *E05B 47/0047* (2013.01); *E05B 63/0056* (2013.01); *E05B 2047/0073* (2013.01); *E05B 2047/0076* (2013.01)

USPC ..... 292/341.16; 292/251.5; 292/341.15; 292/341.18

(58) Field of Classification Search

CPC ..... E05B 2047/0073; E05B 2047/0076; E05B 15/024; E05B 85/04; E05B 15/022; E05B 63/0056; E05B 63/244

USPC ..... 292/1, 251.5, 341.15–341.18

See application file for complete search history.

(56) References Cited

U.S. PATENT DOCUMENTS

| | | | | |
|---|---|---|---|---|
| 5,127,691 | A * | 7/1992 | Herron et al. | 292/341.16 |
| 5,531,086 | A | 7/1996 | Bryant | |
| 5,934,720 | A | 8/1999 | Karalius | |
| 6,299,225 | B1 * | 10/2001 | Chang | 292/341.16 |
| 6,634,685 | B2 * | 10/2003 | Herron et al. | 292/341.16 |
| 6,874,830 | B2 * | 4/2005 | Bashford | 292/341.16 |
| 7,144,053 | B2 * | 12/2006 | Bashford | 292/341.16 |
| 7,322,621 | B2 * | 1/2008 | Liao | 292/341.16 |
| 7,540,542 | B2 * | 6/2009 | Geringer et al. | 292/341.16 |
| 2010/0116006 | A1 * | 5/2010 | Huang | 70/91 |
| 2010/0117383 | A1 * | 5/2010 | Mackle et al. | 292/341.16 |
| 2010/0127518 | A1 * | 5/2010 | Huang | 292/341.16 |

FOREIGN PATENT DOCUMENTS

| | | | | |
|---|---|---|---|---|
| DE | 102007018871 | * | 11/2007 | |
| FR | 2978977 | * | 1/2013 | |
| GB | 2462644 B | * | 9/2010 | |
| WO | WO 2009043089 A1 | * | 4/2009 | E05B 47/00 |

* cited by examiner

*Primary Examiner* — Carlos Lugo

(74) *Attorney, Agent, or Firm* — Charles E. Baxley

(57) ABSTRACT

A lock device includes a tongue engaged in a housing, an anchoring device slidably disposed in the housing and movable with a moving device, the includes two sides each having a latch socket and an anchoring member, when one side of the anchoring device is directed toward the tongue, the lock device is locked when the moving device is turned off, and the lock device is locked when the moving device is turned on and when the other side of the anchoring device is directed toward the tongue, such that the electric lock device is adjustable and operatable when the electromagnetic mechanism of the moving device is either switched on or switched off.

12 Claims, 8 Drawing Sheets

ELECTRIC LOCK DEVICE

BACKGROUND OF THE INVENTION

1. Field of the Invention

The present invention relates to a lock device, and more particularly to an electric and mechanical lock device including a deadbolt or tongue lockable with an electromagnetic mechanism which is adjustable and operatable when the electromagnetic mechanism is either switched on or switched off.

2. Description of the Prior Art

Typical electromagnetic lock devices comprise a core slidably disposed or engaged in a coil and actuatable or movable or operatable with the coil to actuate the core to operate a deadbolt or tongue and to lock or unlock a door or window.

For example, U.S. Pat. No. 5,531,086 to Bryant discloses one of the typical keyless entry deadbolt lock comprising a deadbolt or tongue indirectly coupled to an electromagnetic mechanism with a connecting rod for allowing the deadbolt or tongue to be actuated or operated by the electromagnetic mechanism.

However, the deadbolt or tongue may be disengaged or unlocked from the keeper of the door jamb only when the electromagnetic mechanism is operated or energized, but may not be unlocked when the electromagnetic mechanism is not operated or is not energized.

U.S. Pat. No. 5,934,720 to Karalius discloses another typical low profile release mechanism for electric door strike also comprising a deadbolt or tongue directly coupled to a core of an electromagnetic mechanism for allowing the deadbolt or tongue to be actuated or operated by the core and an actuating coil of the electromagnetic mechanism.

However, the deadbolt or tongue also may be disengaged or unlocked from the keeper of the door jamb only when the electromagnetic mechanism is operated or energized, but may not be unlocked when the electromagnetic mechanism is not operated or is not energized.

The present invention has arisen to mitigate and/or obviate the afore-described disadvantages of the conventional electromagnetic lock devices.

SUMMARY OF THE INVENTION

The primary objective of the present invention is to provide an electric lock device including a deadbolt or tongue lockable with an electromagnetic mechanism which is adjustable and operatable when the electromagnetic mechanism is either switched on or switched off.

In accordance with one aspect of the invention, there is provided a lock device comprising a housing including a chamber formed therein, a tongue engaged in the chamber of the housing and movable between a locked position and an unlocked position, an anchoring device slidably disposed in the chamber of the housing, and including a first side having a first latch socket and a first anchoring member provided therein, and including a second side having a second latch socket and a second anchoring member provided therein, and a moving device operatively for moving the anchoring device relative to the housing, wherein, when the first side of the anchoring device is directed toward the tongue, and when the moving device is turned off, the first anchoring member is aligned with the tongue while the first latch socket of the anchoring device is misaligned with the tongue, so that when the moving device is turned on, the anchoring device will move, so that the first latch socket of the anchoring device is moved to be aligned with the tongue allowing the lock device to be unlocked, wherein, when the second side of the anchoring device is directed toward the tongue, and when the moving device is turned off, the second anchoring member is misaligned with the tongue while the second latch socket is aligned with the tongue allowing the lock device to be unlocked, so that when the moving device is turned on, the anchoring device will move, so that the second anchoring member is moved to be aligned with the tongue while the second latch socket is misaligned with the tongue allowing the lock device to be locked, such that the electric lock device is adjustable and operatable when the electromagnetic mechanism of the moving device is either switched on or switched off.

The moving device includes an electromagnetic mechanism contacted or engaged with the anchoring device for moving the anchoring device relative to the housing to selectively align either the first anchoring member or the second anchoring member with the tongue.

The electromagnetic mechanism includes a core extended out of the electromagnetic mechanism and contacted or engaged with the anchoring device. The housing includes a casing provided in the chamber of the housing and having a compartment formed in the casing for slidably receiving or engaging with the electromagnetic mechanism.

The tongue includes a catch member for selectively engaging with either the first latch socket or the second latch socket of the anchoring device respectively when either of the sides of the anchoring device is faced or directed toward the tongue. The tongue is pivotally mounted to the housing with a pivot axle and includes an actuating outer tongue segment partially exposed or extended out of the housing for latching or locking purposes.

The housing includes a spring biasing member disposed in the chamber of the housing and engaged onto the pivot axle and engaged with the tongue for biasing and forcing the tongue to move or to pivot relative to the housing between the locked position and the unlocked position.

The housing includes a side wall having an opening formed therein for slidably receiving and engaging with the anchoring device. The housing includes a spring biasing member disposed in the opening of the side wall of the housing and engaged with the anchoring device for biasing and forcing the anchoring device toward the moving device.

The housing includes a lid engaged with the housing for enclosing the opening of the side wall and for retaining the anchoring device and the spring biasing member in the opening of the side wall.

The housing includes a partition extended in the chamber of the housing and located beside the side wall for forming a space between the partition and the side wall, and the partition includes an orifice formed therein and aligned with the opening of the side wall of the housing for slidably receiving and engaging with the anchoring device.

The anchoring device includes one or more guiding surfaces formed therein, and the housing includes one or more guiding surfaces formed therein for engaging with the corresponding guiding surfaces of the anchoring device and for guiding the anchoring device to slide relative to the housing only, and for preventing the anchoring device from rotating relative to the housing.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
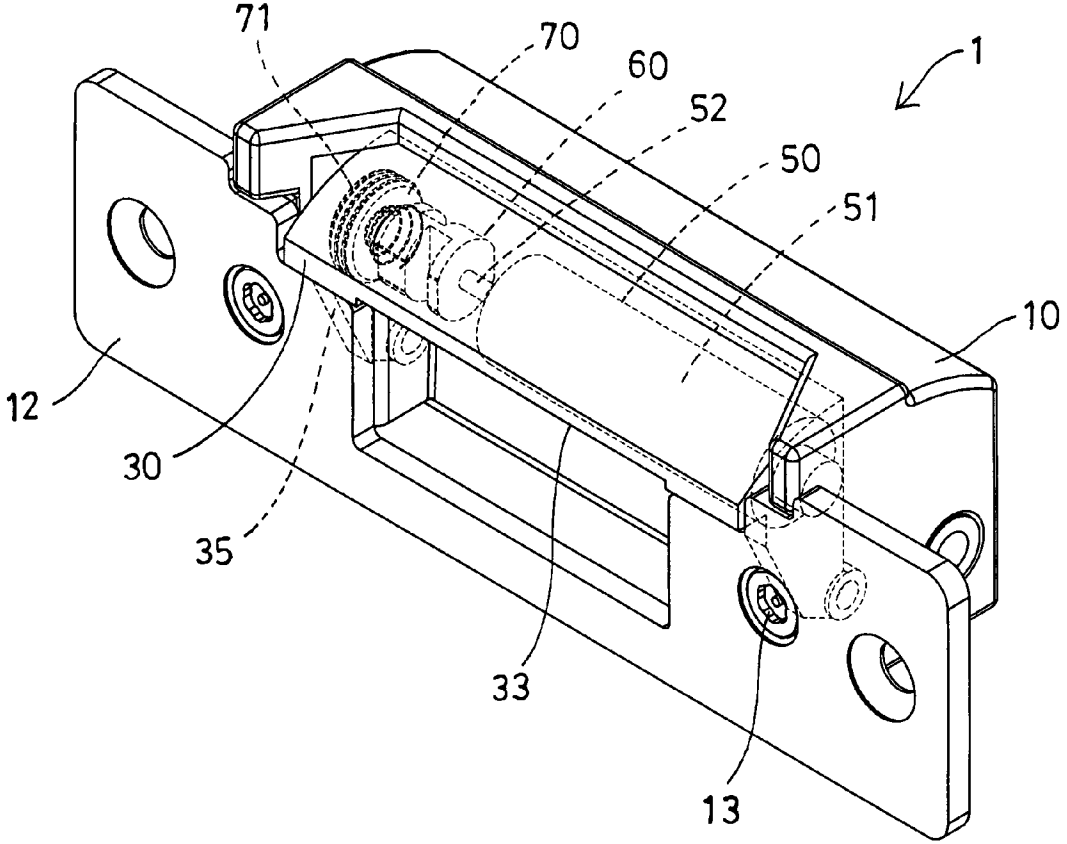
FIG. 1 is a perspective view of an electric lock device in accordance with the present invention.

Referring to the drawings, and initially to FIGS. 1-4, an electric lock device 1 in accordance with the present invention comprises a housing 10 including a chamber 11 formed therein for receiving various parts or elements or the like, and including a cover 12 secured to one side or the upper or front portion of the housing 10 with such as latches or fasteners 13 for forming or defining the chamber 11 of the housing 10, and including an opening 14 formed in one of the side walls 15 and communicative with the chamber 11 of the housing 10, and including a shelf or rack or compartment 16 formed in the housing 10 and also communicative with the chamber 11 of the housing 10.

For example, the housing 10 may include a frame or casing 20 (FIG. 3) formed or provided in the chamber 11 of the housing 10 and having the compartment 16 formed or defined in the casing 20. The housing 10 further includes a wall member or partition 17 extended in the chamber 11 of the housing 10 and located beside or close to the side wall 15, and disposed or located between the opening 14 and the compartment 16 of the housing 10 for forming or defining a gap or space 19 between the partition 17 and the side wall 15 (FIGS. 3, 6), and the partition 17 includes an orifice 18 formed therein and located between and aligned with the opening 14 and the compartment 16 of the housing 10.

A deadbolt or latch bolt or tongue 30 is pivotally or rotatably or movably received or engaged in the chamber 11 of the housing 10, and includes one or first end or an inner portion 31 pivotally or rotatably attached or mounted or secured or coupled to the housing 10 with a pivot axle 32, and includes the other or second or an outer portion or an actuating outer tongue segment 33 partially exposed or extended out of the housing 10 (FIG. 1) for latching or locking purposes and for allowing the tongue 30 to be pivotal or movable between a locked position and an unlocked position, and includes one of the side fences or a catch member 35 located in or aligned with, and movable into or out of the space 19 that is formed or defined between the partition 17 and the side wall 15 of the housing 10.

For example, the tongue 30 of the housing 10 and/or of the electric lock device 1 may be attached or engaged into a door panel (not shown) and disposed or arranged on either the inner side or the outer side of the door jambs or the door frames (not shown) for selectively engaging with the keepers (not shown) of the door jambs or the door frames, and for selectively latching or locking the door panel to the door jambs or the door frames, or for selectively unlocking or releasing the door panel from the door jambs or the door frames. The engagement of the tongue 30 with the keepers of the door jambs or the door frames is not related to the present invention and will not be described in further details.

Figure 2:
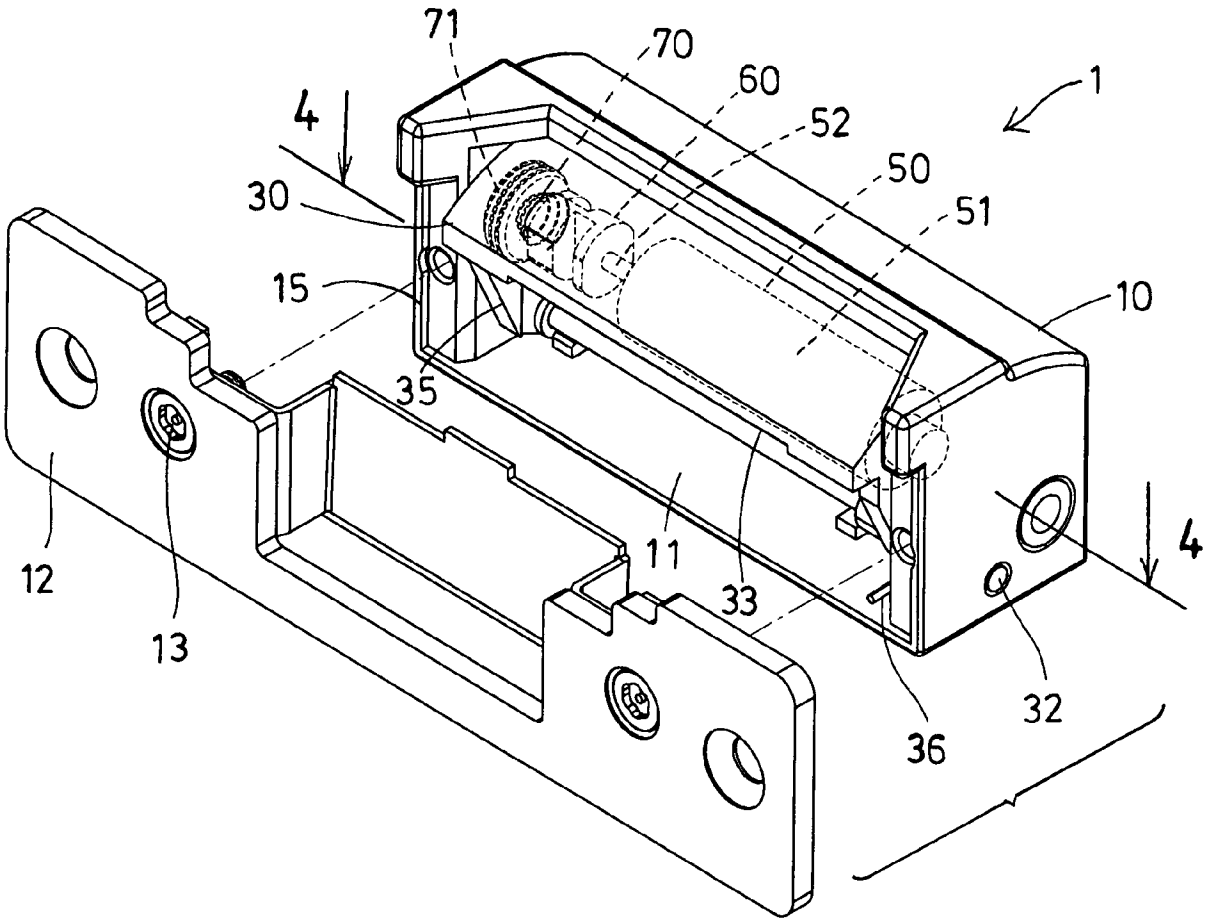
FIG. 2 is a partial exploded view of the electric lock device.
Figure 3:
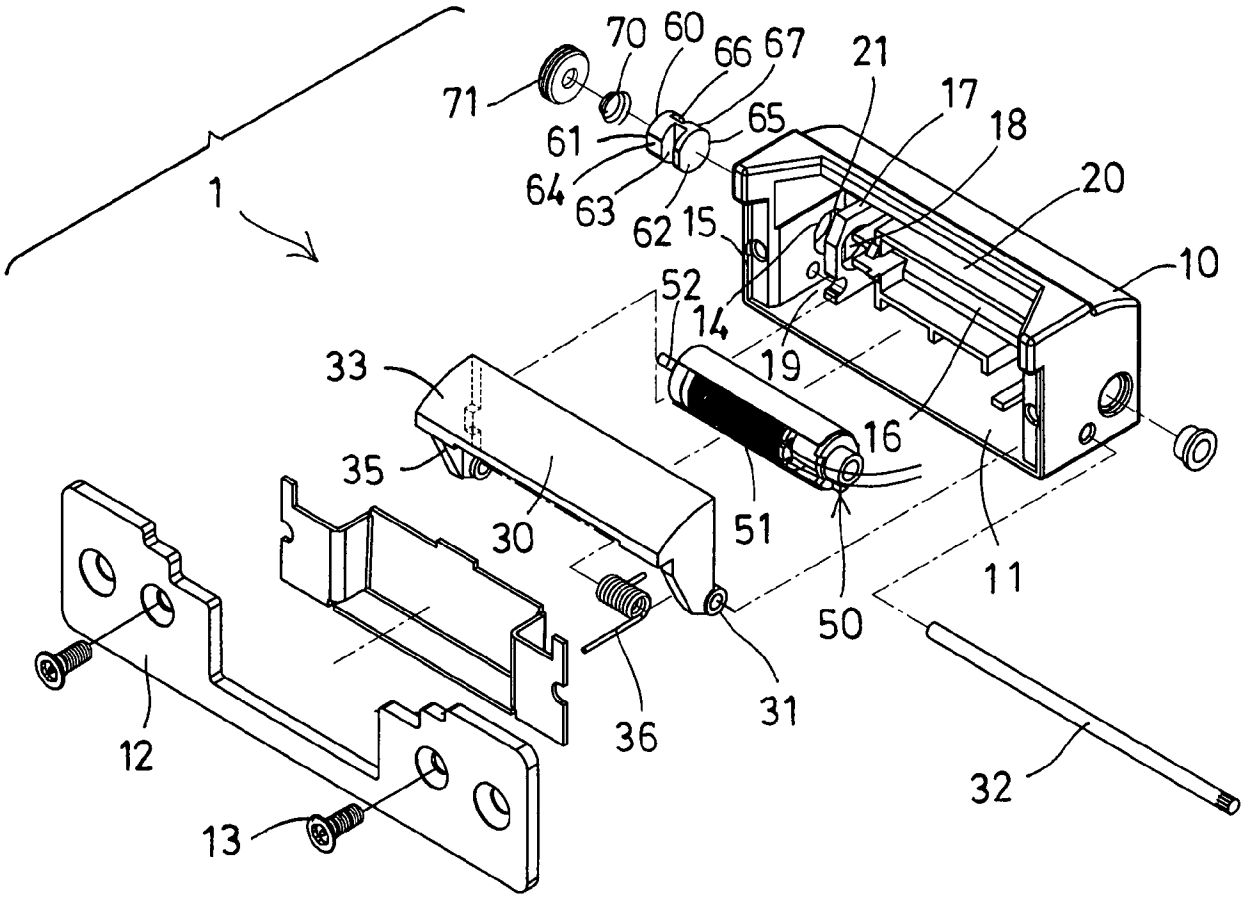
FIG. 3 is another partial exploded view of the electric lock device.

As shown in FIGS. 2 and 3, a spring biasing means or member 36 may be attached or disposed in the chamber 11 of the housing 10, and attached or mounted or engaged onto the pivot axle 32, and engaged with and between the housing 10 and the tongue 30, for biasing or forcing the tongue 30 into or out of the housing 10 and to be moved relative to the keepers of the door jambs or the door frames. The catch member 35 of the tongue 30 may be selectively moved into or out of the space 19 that is formed or defined between the partition 17 and the side wall 15 of the housing 10 against the spring biasing member 36 manually with a key or handle (not shown) or the like or electrically with an electromagnetic mechanism (not shown) or the like.

An operating or locking or moving means or device 50 includes an electromagnetic mechanism 51 attached or disposed or mounted or engaged in the compartment 16 of the casing 20, and includes a core 52 slidably received or engaged in and extendible out of the electromagnetic mechanism 51, and slidable or extendible or movable toward and away from the partition 17 and the side wall 15 of the housing 10 for moving an anchoring device 60 along the opening 14 of the side wall 15 and the orifice 18 of the partition 17, and for moving the anchoring device 60 relative to the partition 17 and the side wall 15 of the housing 10.

The anchoring device 60 is slidably received or disposed or engaged in the opening 14 of the side wall 15 and the orifice 18 of the partition 17, and contacted or engaged with the core 52 of the electromagnetic mechanism 51 or of the moving device 50 for allowing the anchoring device 60 to be moved relative to the partition 17 and the side wall 15 of the housing 10 and the catch member 35 of the tongue 30 with the electromagnetic mechanism 51 of the moving device 50. The anchoring device 60 includes one or more (such as two) cut off portions or flat guiding surfaces 61 (FIG. 3) oppositely formed therein for selectively engaging with the corresponding cut off portions or flat guiding surfaces 21 of the housing 10 and for preventing the anchoring device 60 from rotating relative to the housing 10.

A spring biasing means or member 70 is disposed or engaged into the opening 14 of the side wall 15 and contacted or engaged with the anchoring device 60 for biasing or forcing the anchoring device 60 toward and to engage with the core 52 of the electromagnetic mechanism 51 or of the moving device 50 and for allowing the anchoring device 60 to be moved along the opening 14 of the side wall 15 and the orifice 18 of the partition 17, and for moving the anchoring device 60 relative to the partition 17 and the side wall 15 of the housing 10. A lid 71 is threaded or engaged with the housing 10 for blocking or enclosing the opening 14 of the side wall 15 and for solidly and stably anchoring or retaining the anchoring device 60 and the spring biasing member 70 in the opening 14 of the side wall 15.

The anchoring device 60 includes one or first side or portion or a front portion 62 having a first latch socket 63 and a first stop or anchoring member 64 formed or provided therein, and includes the other or second side or portion or a rear portion 65 having a second latch socket 66 and a second stop or anchoring member 67 formed or provided therein, as best shown in FIGS. 4-8, the latch sockets 63, 66 and the anchoring members 64, 67 are offset from each other, or the first latch socket 63 is located closer to the second anchoring member 67, and the first anchoring member 64 is located closer to the second latch socket 66.

Figure 4:
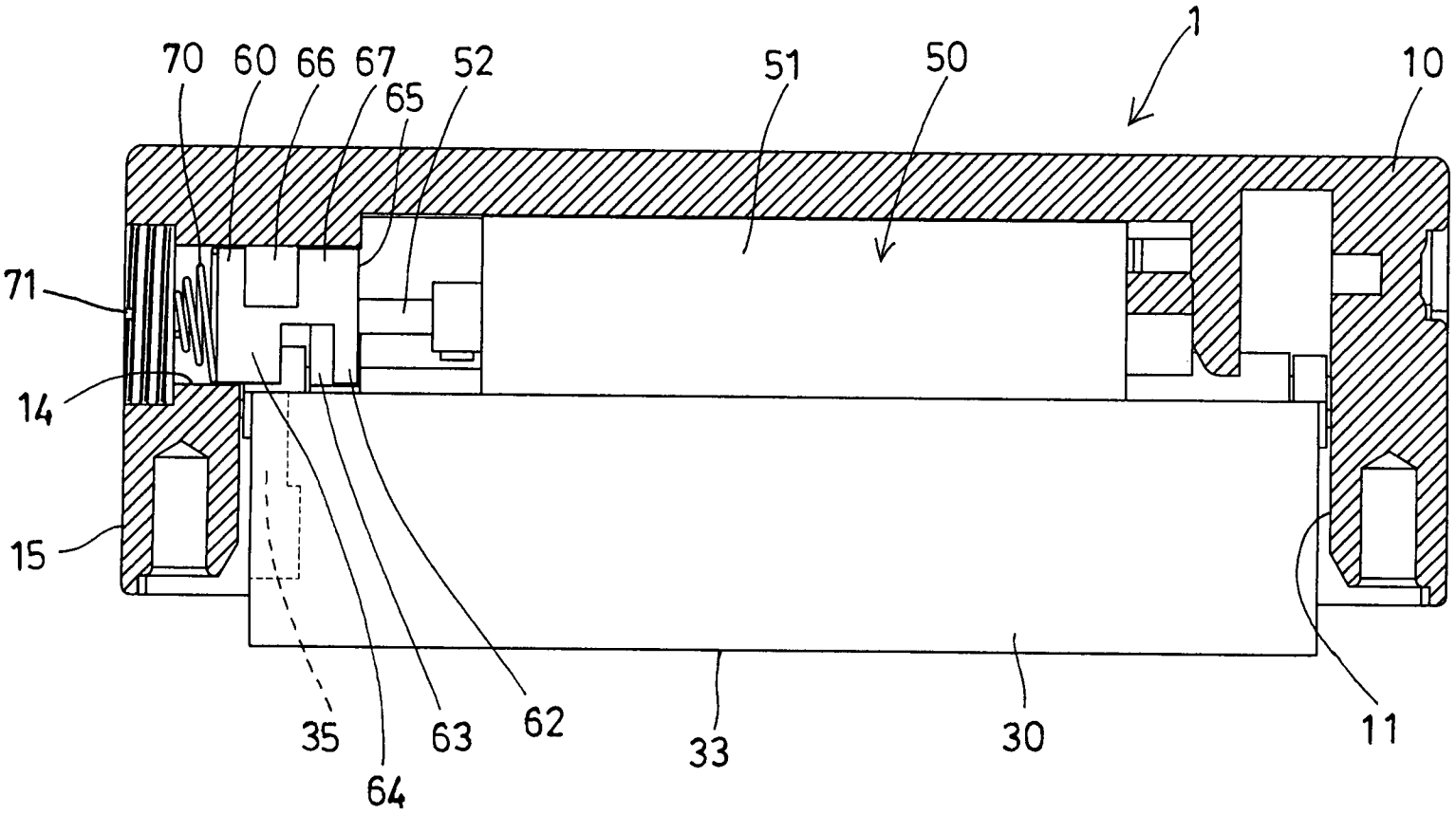
FIG. 4 is a cross sectional view of the electric lock device, taken along lines 4-4 of FIG. 2.
Figure 5:
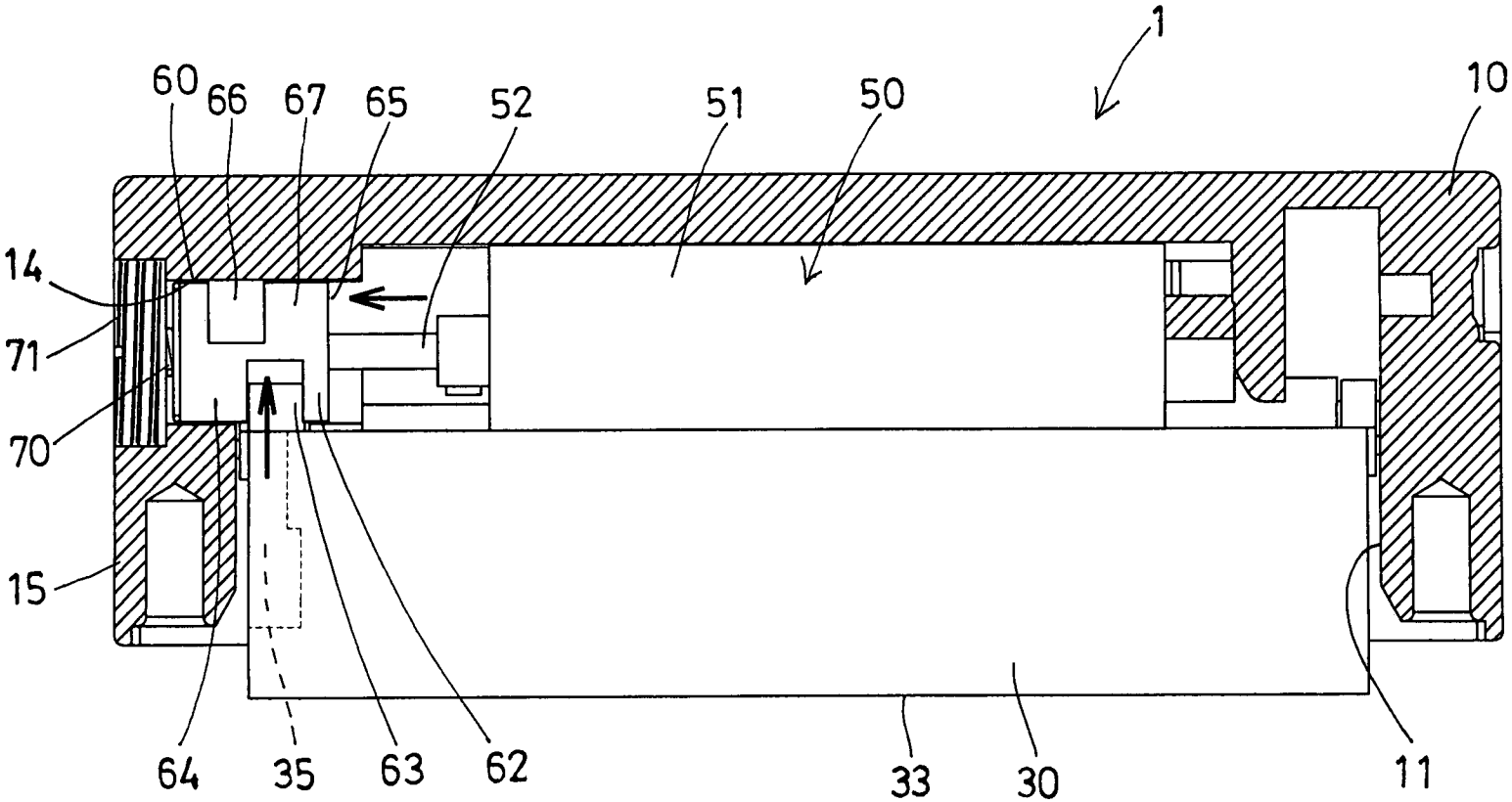
FIG. 5 is a cross sectional view similar to FIG. 4, illustrating the operation of the electric lock device.

In operation, as shown in FIG. 4, when the first side or front portion 62 of the anchoring device 60 is directed or faced toward the catch member 35 of the tongue 30 and when the electromagnetic mechanism 51 of the moving device 50 is not energized or actuated or operated, the spring biasing member 70 may bias or force the anchoring device 60 toward and to engage with the core 52 of the electromagnetic mechanism 51 or of the moving device 50 and to offset or misalign the first latch socket 63 of the anchoring device 60 from the catch member 35 of the tongue 30, and to align the first anchoring member 64 with the catch member 35 of the tongue 30, and to prevent the catch member 35 of the tongue 30 from moving or engaging into the first latch socket 63 of the anchoring device 60, such that the tongue 30 is locked in place when the moving device 50 is not energized or actuated or operated.

When the electromagnetic mechanism 51 is energized or switched on or actuated or operated to move the anchoring device 60 away from the electromagnetic mechanism 51, the first anchoring member 64 may be moved and misaligned or disengaged from the catch member 35 of the tongue 30, and the first latch socket 63 of the anchoring device 60 may be moved and aligned with the catch member 35 of the tongue 30 for allowing the catch member 35 of the tongue 30 to be selectively moved or engaged into the first latch socket 63 of the anchoring device 60 when the electromagnetic mechanism 51 is energized or switched on or actuated or operated.

Figure 6:
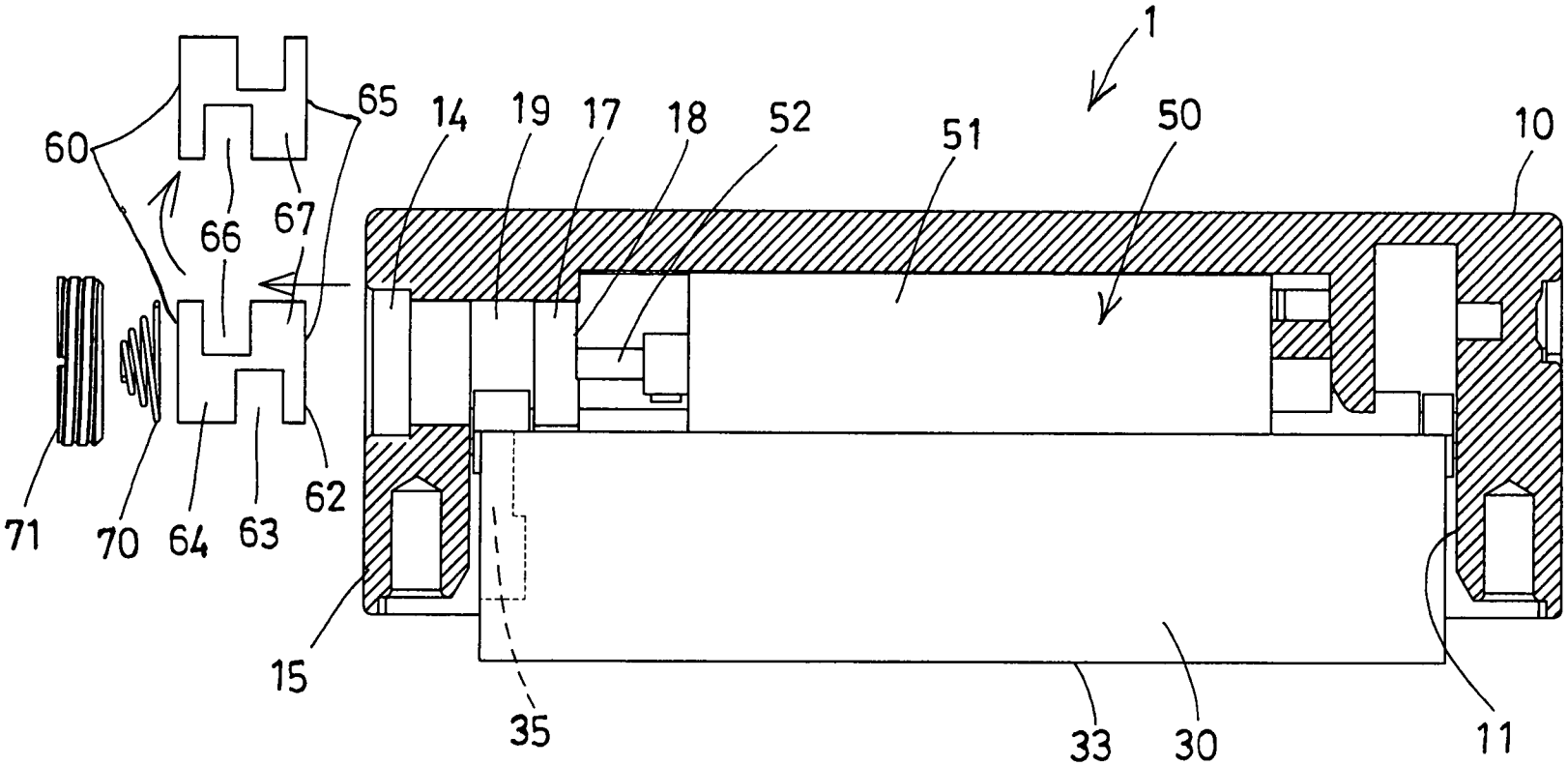
FIG. 6 is a cross sectional and partial exploded view illustrating the operation of the electric lock device.

As shown in FIG. 6, the lid 71 may be selectively unthreaded or disengaged from the housing 10 for opening or releasing the opening 14 of the side wall 15 and for allowing the anchoring device 60 and the spring biasing member 70 to be removed or disengaged from the opening 14 of the side wall 15 of the housing 10. The anchoring device 60 may then be rotated relative to the housing 10 for about 180 degrees to direct or face the second latch socket 66 and the second anchoring member 67 of the anchoring device 60 toward the catch member 35 of the tongue 30, or to direct or space the first latch socket 63 and the first anchoring member 64 of the anchoring device 60 away from the catch member 35 of the tongue 30.

Figure 8:
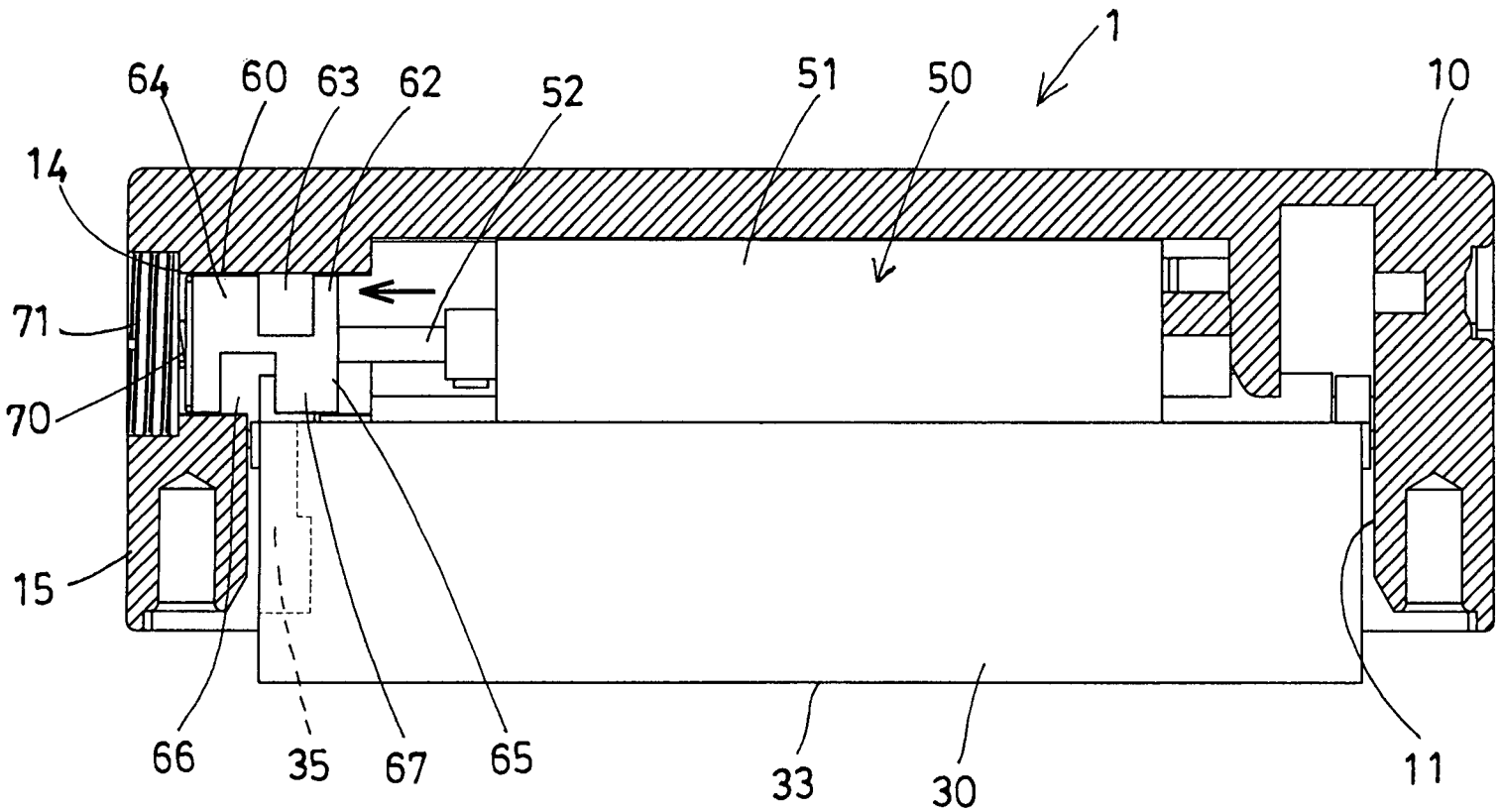

At this situation, as shown in FIG. 8, when the electromagnetic mechanism 51 is normally switched on or energized or actuated or operated, the second anchoring member 67 of the anchoring device 60 may be moved and aligned with the catch member 35 of the tongue 30 for preventing the catch member 35 of the tongue 30 from moving or engaging into the second latch socket 66 of the anchoring device 60, such that the tongue 30 is locked in place when the moving device 50 is normally switched on or energized or actuated or operated.

Figure 7:
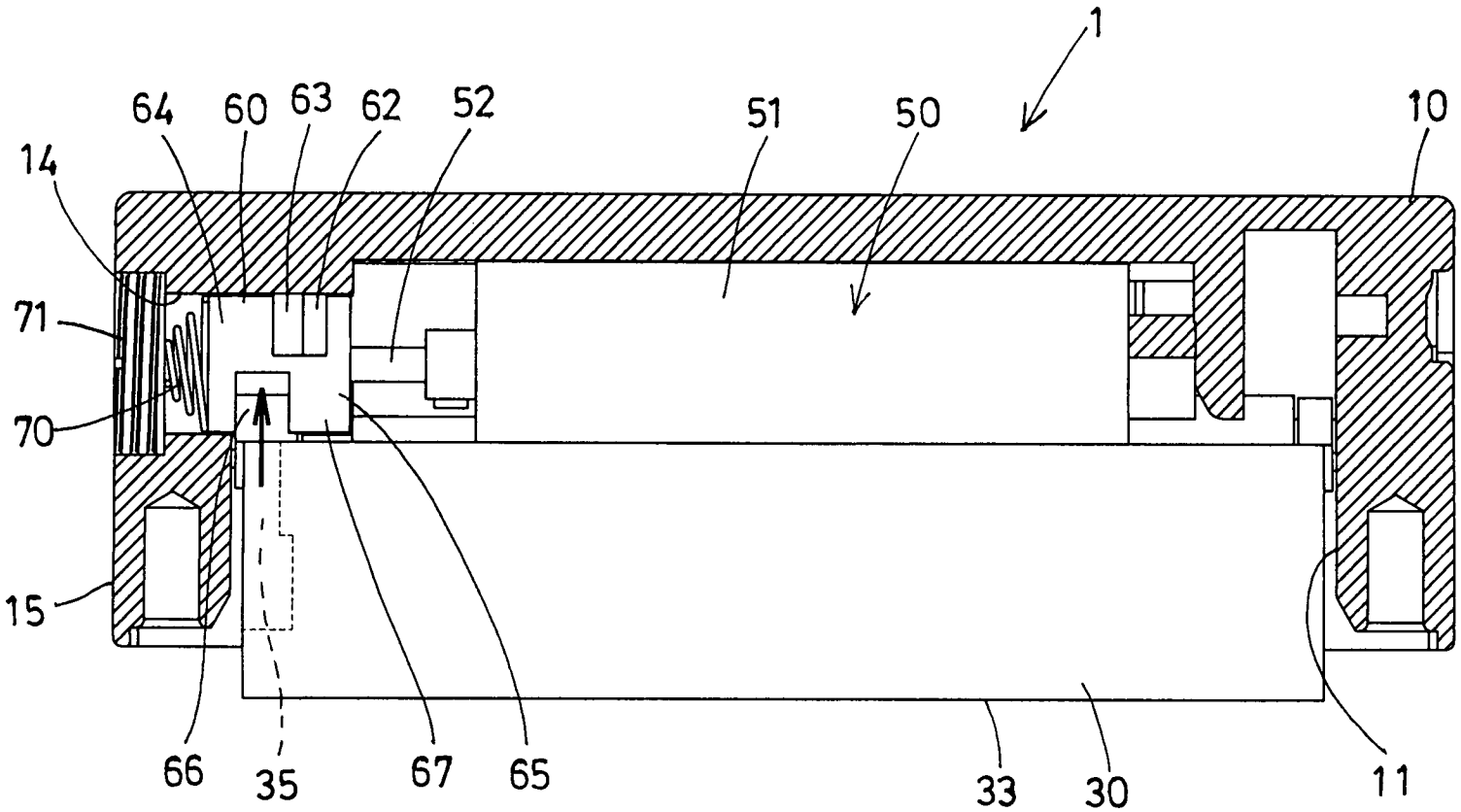
FIGS. 7, 8 are cross sectional views similar to FIGS. 4 and 5, illustrating the operation of the electric lock device.

As shown in FIG. 7, when the electromagnetic mechanism 51 is switched off, the anchoring device 60 may be moved toward the electromagnetic mechanism 51 by the electromagnetic mechanism 51 or with the spring biasing member 70, and the second latch socket 66 of the anchoring device 60 may be moved and aligned with the catch member 35 of the tongue 30 for allowing the catch member 35 of the tongue 30 to be selectively moved or engaged into the second latch socket 66 of the anchoring device 60 when the electromagnetic mechanism 51 is not energized or actuated or operated.

It is to be noted that the tongue 30 may be locked and may be prevented from being rotated relative to the housing 10 when the electromagnetic mechanism 51 is energized or normally switched on (FIG. 8) and when the second anchoring member 67 of the anchoring device 60 is aligned with the catch member 35 of the tongue 30. Alternatively, or on the contrary, as shown in FIG. 4, the tongue 30 may be locked and may be prevented from being rotated relative to the housing 10 when the electromagnetic mechanism 51 is switched off and when the first anchoring member 64 is aligned with the catch member 35 of the tongue 30.

Accordingly, the electric lock device in accordance with the present invention includes a deadbolt or tongue lockable with an electromagnetic mechanism which is adjustable and operatable when the electromagnetic mechanism is either switched on or switched off.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A lock device comprising:

a housing including a chamber formed therein;

a tongue engaged in said chamber of said housing and movable between a locked position and an unlocked position;

an anchoring device slidably disposed in said chamber of said housing, and including a first side having a first latch socket and a first anchoring member provided therein, and including a second side having a second latch socket and a second anchoring member provided therein;

a moving device operatively for moving said anchoring device relative to said housing; and a spring biasing member disposed in said housing and engaged with said anchoring device for biasing and forcing said anchoring device toward said moving device;

wherein, when said first side of said anchoring device is directed toward said tongue, and when said moving device is turned off, said first anchoring member is aligned with said tongue while said first latch socket of said anchoring device is misaligned with said tongue, so that when said moving device is turned on, said anchoring device will move, so that said first latch socket of said anchoring device is moved to be aligned with said tongue allowing said lock device to be unlocked;

wherein, said anchoring device is removable from said housing to adjust said first side to said second side, when said second side of said anchoring device is directed toward said tongue, and when said moving device is turned off, said second anchoring member is misaligned with said tongue while said second latch socket is aligned with said tongue allowing said lock device to be unlocked, so that when said moving device is turned on, said anchoring device will move, so that said second anchoring member is moved to be aligned with said tongue while said second latch socket is misaligned with said tongue allowing said lock device to be locked.

2. The lock device as claimed in claim 1, wherein said moving device includes an electromagnetic mechanism engaged with said anchoring device for moving said anchoring device relative to said housing to selectively align either said first anchoring member or said second anchoring member with said tongue.

3. The lock device as claimed in claim 2, wherein said electromagnetic mechanism includes a core extended out of said electromagnetic mechanism and engaged with said anchoring device.

4. The lock device as claimed in claim 2, wherein said housing includes a casing provided in said chamber of said housing and having a compartment formed in said casing for receiving said electromagnetic mechanism.

5. The lock device as claimed in claim 1, wherein said tongue includes a catch member for selectively engaging with either said first latch socket or said second latch socket of said anchoring device.

6. The lock device as claimed in claim 1, wherein said tongue is pivotally mounted to said housing with a pivot axle.

7. The lock device as claimed in claim 6, wherein said housing includes a spring biasing member disposed in said chamber of said housing and engaged onto said pivot axle and engaged with said tongue for biasing and forcing said tongue to move relative to said housing.

8. The lock device as claimed in claim 1, wherein said housing includes a side wall having an opening formed therein for slidably receiving and engaging with said anchoring device.

9. The lock device as claimed in claim 8, wherein said spring biasing member is disposed in said opening of said side wall of said housing and engaged with said anchoring device for biasing and forcing said anchoring device toward said moving device.

10. The lock device as claimed in claim 9, wherein said housing includes a lid engaged with said housing for enclosing said opening of said side wall and for retaining said anchoring device and said spring biasing member in said opening of said side wall.

11. The lock device as claimed in claim 8, wherein said housing includes a partition extended in said chamber of said housing and located beside said side wall for forming a space between said partition and said side wall, and said partition includes an orifice formed therein and aligned with said opening of said side wall of said housing.

12. The lock device as claimed in claim 1, wherein said anchoring device includes a guiding surface formed therein, and said housing includes a guiding surface formed therein for engaging with said guiding surface of said anchoring device and for preventing said anchoring device from rotating relative to said housing.

* * * * *